US007414634B2

(12) United States Patent
Takemura et al.

(10) Patent No.: US 7,414,634 B2
(45) Date of Patent: Aug. 19, 2008

(54) AUDIO SIGNAL PROCESSING SYSTEM

(75) Inventors: Satoshi Takemura, Hamamatsu (JP); Akihiro Miwa, Hamamatsu (JP); Makoto Hiroi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 384 days.

(21) Appl. No.: 11/058,487

(22) Filed: Feb. 14, 2005

(65) Prior Publication Data

US 2005/0182633 A1 Aug. 18, 2005

(30) Foreign Application Priority Data

Feb. 16, 2004 (JP) ..... 2004-037799

(51) Int. Cl.
*G09G 5/00* (2006.01)

(52) U.S. Cl. ..... 345/619; 715/727

(58) Field of Classification Search ..... 345/619; 386/54

See application file for complete search history.

(56) References Cited

U.S. PATENT DOCUMENTS 5,386,568 A 1/1995 Wold et al.
5,911,030 A * 6/1999 Kikuchi et al. ..... 386/55
5,940,573 A * 8/1999 Beckwith ..... 386/54
6,738,964 B1 * 5/2004 Zink et al. ..... 717/105

OTHER PUBLICATIONS

"Yamaha Digital Mixing Engine DME32, Owner's Manual", by Yamaha Corporation, Pro Audio & Digital Musical Instrument Division, Japan.

* cited by examiner

*Primary Examiner*—Motilewa Good-Johnson
(74) *Attorney, Agent, or Firm*—Morrison & Foerster LLP

(57) ABSTRACT

In a mixer system including a mixer engine wherein contents of signal processing can be programmed and a PC that edits the configuration of signal processing, the PC is provided with a display controller that graphically displays the edited configuration of signal processing using components for the signal processing and wires connecting nodes of the components; an accepting device that accepts designation of a node or wire whose signal is desired to be monitored, in a screen thereof; and a directing device that directs the mixer engine to output the signal from the designated node or wire to a monitoring analog signal output in accordance with the designation, and the mixer engine is provided with an outputting device that outputs a signal to the monitoring analog signal output in accordance with the direction separately from the signal processing relating to the edited signal processing configuration.

7 Claims, 8 Drawing Sheets

AUDIO SIGNAL PROCESSING SYSTEM

BACKGROUND OF THE INVENTION

1. Field of the Invention

The invention relates to an audio signal processing system in which an editing device edits contents of signal processing in an audio signal processing device and the audio signal processing device performs the signal processing in accordance with the edited contents, and a program for causing a computer to function as the editing device.

2. Description of the Related Art

Conventionally, there has been a well-known audio signal processing device in which an audio signal processing module is composed using a processor operable following a program, and an external computer such as a PC (personal computer) or the like functions as an editing device so that audio signals can be processed based on a configuration of signal processing edited using the editing device. Such an audio signal processing device is called a mixer engine in the present application. The mixer engine stores therein the configuration of signal processing edited by the PC and can independently perform processing on audio signals based on the stored configuration of signal processing. Further, this mixer engine constitutes an audio signal processing system together with the above-described editing device.

For the edit of the configuration of signal processing on the editing device, the components being constituent elements for the signal processing in editing and a wiring status between their input and output nodes are graphically displayed on a display to allow users to perform editing work in an environment where the configuration of signal processing can be easily grasped visually. Then, a user can arrange desired processing components and set wires between the arranged components, thereby editing the configuration of signal processing.

The audio signal processing system described above and the application software for causing a computer to function as the editing device is described, for example, in Owner's Manual of a digital mixing engine "DME32 (trade name)" available from YAMAHA Co., especially pp. 23 to 66 (pp. 21 to 63 in English version).

SUMMARY OF THE INVENTION

Incidentally, when the audio signal processing system described above is operated, there has been a demand in which the state of signals is monitored during processing in an audio signal processing device. In the conventional audio signal processing system, however, signal can be outputted only from an output component. Therefore, to monitor the state, it has been required to reserve, for monitoring, any one of output nodes of an output component and then set a monitoring wire connecting a node or wire whose signal is desired to be monitored and the output node at the time of editing signal processing configuration.

Accordingly, when the monitoring is performed, there is a problem of usable output nodes, for outputting signal after processing, being fewer than those originally usable. In addition, when a signal at another position is to be monitored, there is another problem of the necessity to reedit the signal processing configuration and set it again in the audio signal processing device, resulting in poor operability. In particular, an operation of monitoring signals at a plurality of positions in sequence is difficult to perform.

The signal processing relating to the wire for monitoring is performed as a series of signal processing similar to signal processing of other portions, and therefore the edited signal processing configuration using hardware resource of the audio signal processing device to the fullest extent, may bring about another problem of failing to add the wire for monitoring.

An object of the invention is to solve the above-described problems and to make it possible to easily monitor a signal during processing in an audio signal processing system including an audio signal processing device having a signal processor wherein processing contents can be programmed and an editing device for editing the configuration of signal processing in the audio signal processing device.

To achieve the above object, an audio signal processing system of the invention includes an audio signal processing device having a signal processor wherein processing contents can be programmed, and an editing device that edits a configuration of signal processing including a plurality of components each having an input node or an output node and wires connecting the output nodes and input nodes of the components in the audio signal processing device, wherein the editing device is provided with: a display controller that graphically displays the edited configuration of signal processing on a screen of a display using the components and the wires; a transferring device that transfers the edited configuration of signal processing to the audio signal processing device; an accepting device that accepts designation of a node or wire whose signal is desired to be monitored, in the screen displaying the configuration of signal processing; and a directing device that directs the audio signal processing device to output the signal from the designated node or wire to a predetermined output portion in accordance with the designation accepted by the accepting device, and wherein the audio signal processing device is provided with: a processor that performs signal processing in accordance with the configuration of signal processing transferred from the editing device; and an outputting device that outputs a signal to the predetermined output portion in accordance with the direction from the directing device separately from the signal processing.

In the audio signal processing system described above, it is preferable that the predetermined output portion is an output portion for outputting a signal from the audio signal processing device to the editing device, and that the editing device is provided with a second outputting device that outputs the signal inputted from the audio signal processing device to a sound out device.

Further, the invention also provides an audio signal processing system including an audio signal processing device that is connected to a network and has a signal processor wherein processing contents can be programmed, and an editing device that is connected to the network and edits a configuration of signal processing including a plurality of components each having an input node or an output node and wires connecting the output nodes and input nodes of the components in the audio signal processing device, wherein the editing device is provided with: a display controller that graphically displays the edited configuration of signal processing on a screen of a display using the components and the wires; a transferring device that transfers the edited configuration of signal processing to the audio signal processing device via the network; an accepting device that accepts designation of a node or wire whose signal is desired to be monitored, in the screen displaying the configuration of signal processing; a directing device that directs via the network the audio signal processing device to transmit the signal at the designated node or wire to the editing device via the network in accordance with the designation accepted by the accepting device; and an outputting device that outputs to a sound out device the signal received from the audio signal processing device via the network, and wherein the audio signal processing device is provided with: a processor that performs signal processing in accordance with the configuration of signal processing transferred from the editing device; and a transmitting device that transmits a signal at a directed node or wire to the editing device via the network in accordance with the direction from the directing device separately from the signal processing.

Further, in each of the above-described audio signal processing system, it is suitable that the signal processor of the audio signal processing device is constituted of a plurality of processors that transmit/receive to/from each other a plurality of signals via a plurality of signal transmission channels, and that at least one of the plurality of signal transmission channels is reserved as a signal transmission channel for signal output in accordance with the direction from the directing device.

Further, a computer program of the invention is a computer program containing program instructions executable by a computer and causing the computer to execute: a process of editing a configuration of signal processing in an audio signal processing device having a signal processor wherein processing contents can be programmed, including a plurality of components each having an input node or an output node and wires connecting the output nodes and input nodes of the components; a process of graphically displaying the edited configuration of signal processing on a screen of a display using the components and the wires; a process of transferring the edited configuration of signal processing to the audio signal processing device; an acceptance process of accepting designation of a node or wire whose signal is desired to be monitored, in the screen displaying the configuration of signal processing; and a direction process of directing the audio signal processing device to output the signal from the designated node or wire to a predetermined output portion in accordance with the designation accepted in the acceptance process.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, a preferred embodiment of the invention will be concretely described with reference to the drawings.

Figure 1:
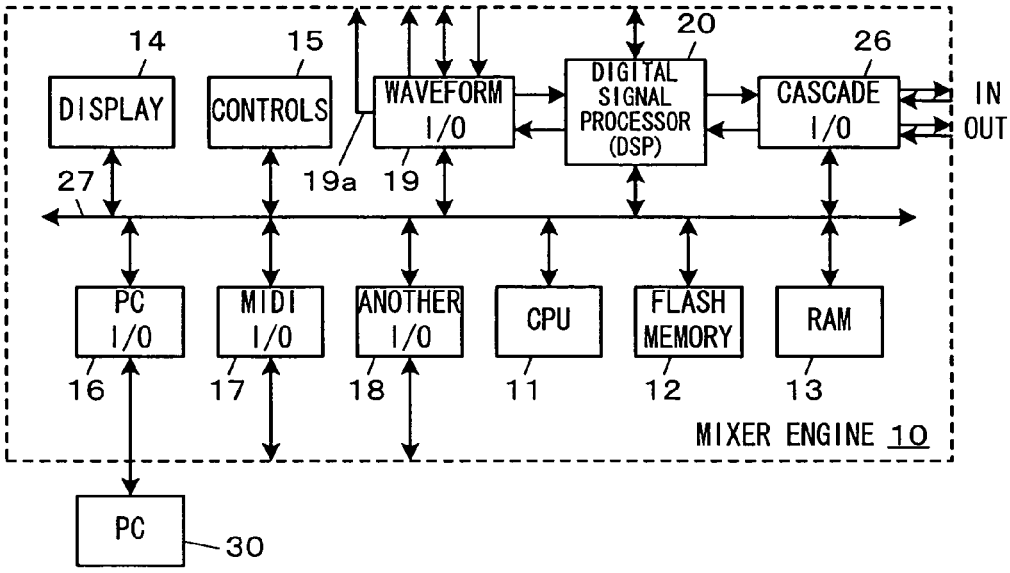
FIG. 1 is a block diagram showing a configuration of a mixer system being an embodiment of an audio signal processing system of the invention.

A configuration of a mixer system being an embodiment of an audio signal processing system of the invention which comprises a PC being an editing device and a mixer engine being an audio signal processing device will first be described using FIG. 1. FIG. 1 is a block diagram showing the configuration of the mixer system.

As shown in FIG. 1, the mixer system comprises a mixer engine 10 and a PC 30. The PC 30 can employ, as hardware, a well-known PC having a CPU, a ROM, a RAM and so on and a display, that is, a PC on which an operating system (OS) such as Windows XP (registered trademark) runs. By executing an edit program being an embodiment of a program of the invention as an application program on the OS, the PC 30 can function as the editing device which edits a configuration of signal processing in the mixer engine 10, transfers the edit result to the mixer engine 10, and causes the mixer engine 10 to operate in accordance with the edited configuration of signal processing. The operation and function of the PC 30 described below should be realized by executing the edit program unless otherwise stated.

On the other hand, the mixer engine 10 includes a CPU 11, a flash memory 12, a RAM 13, a display 14, controls 15, a PC input and output module (I/O) 16, a MIDI (Musical Instruments Digital Interface) I/O 17, another I/O 18, a waveform I/O 19, a digital signal processor (DSP) 20, and a cascade I/O 26, which are connected by a CPU bus 27. The mixer engine 10 has functions of generating a microprogram for controlling the DSP 20 in accordance with the configuration of signal processing received from the PC 30, operating the DSP 20 in accordance with the microprogram to thereby perform various signal processing on inputted audio signals and output them.

The CPU 11, which is a controller that comprehensively controls operation of the mixer engine 10, executes a predetermined program stored in the flash memory 12 to thereby perform processing such as controlling communication at each of the I/Os 16 to 19 and 26 and display on the display 14, detecting operations at the controls 15 and changing values of parameters in accordance with the operations, and generating the microprogram for operating the DSP 20 from data on the configuration of signal processing received from the PC 30 and installing the program in the DSP 20.

The flash memory 12 is a rewritable non-volatile memory that stores a control program executed by the CPU 11, later-described preset component data and so on.

The RAM 13 is a memory that stores various kinds of data including later-described configuration data generated by converting the data on the configuration of signal processing received from the PC 30 into a required form and current data, and is used as a work memory by the CPU 11.

The display 14 is a display composed of a liquid crystal display (LCD) or the like. The display 14 displays a screen for indicating the current state of the mixer engine 10, a screen for referring to, modifying, saving, and so on of scenes being setting data contained in the configuration data, and so on.

The controls 15 are controls composed of keys, switches, rotary encoders, and so on, with which a user directly operates the mixer engine 10 to edit scenes and so on.

The PC I/O 16 is an interface for communicating with the PC 30, and can be an interface of, for example, a USB (Universal Serial Bus) standard, an Ethernet (registered trademark) standard, or the like.

The MIDI I/O 17 is an interface for sending and receiving data in compliance with MIDI standard, and is used, for example, to communicate with an electronic musical instrument compatible with MIDI, a computer with an application program for outputting MIDI data, or the like.

The waveform I/O 19 is an interface for accepting input of audio signals to be processed in the DSP 20 and outputting processed audio signals. A plurality of A/D conversion boards each capable of analog input of four channels, D/A conversion boards each capable of analog output of four channels, and digital input and output boards each capable of digital input and output of eight channels, can be installed in combination as necessary into the waveform I/O 19, which actually inputs and outputs signals through the boards. Further, the mixer engine 10 is provided with a monitoring analog signal output 19*a* as a monitoring sound out terminal being an output portion for monitoring audio signals being processing objects in the DSP 20, and signal output to the monitoring analog signal output 19*a* is also performed via the waveform I/O 19. In this event, the waveform I/O 19 outputs the fetched signal after D/A converting it. Concretely, for example, a headphone terminal may possibly be employed as the monitoring analog signal output 19*a*.

The cascade I/O 26 is an interface for transmitting/receiving audio signals, and data, command, and so on from the PC 30 to/from other mixers when a plurality of mixer engines 10 are cascade-connected for use. Note that when the plurality of mixer engines 10 are used cascade-connected, it is possible to cause the plurality of mixer engines 10 to cooperatively operate to perform a series of audio signal processing. Further, the PC 30 can edit the above-described configuration of the audio signal processing and transfer the edited result also to the other mixer engines 10 via the mixer engine 10 directly connected to the PC 30, and cause each of the mixer engines 10 to operate in accordance with the edited signal processing configuration.

The another I/O 18 is an interface for connecting devices other than the above-described to perform input and output, and for example, interfaces for connecting a display, a mouse, a keyboard for inputting characters, a control panel, and so on in an external part are prepared.

The DSP 20 is a signal processor which includes a signal processing circuit to perform processing on audio signals inputted from the waveform I/O 19 in accordance with the set microprogram and the current data determining its processing parameters.

Figure 2:
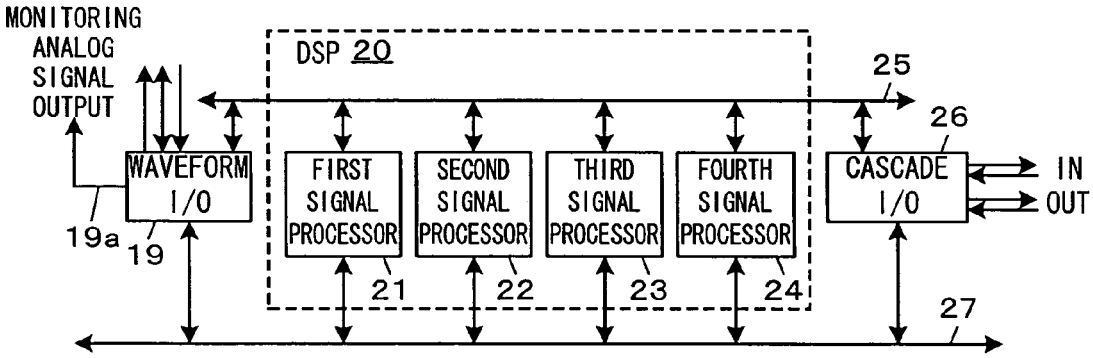
FIG. 2 is a diagram showing a configuration of a DSP and its periphery shown in FIG. 1 in more detail.

The configuration of the DSP 20 and its periphery is shown in more detail in FIG. 2.

The DSP 20 may be constituted of one processor or a plurality of processors connected and is constituted here of four, that is, a first to a fourth signal processor 21 to 24 connected as shown in FIG. 2. Further, the signal processors, the waveform I/O 19, and the cascade I/O 26 are connected to a waveform bus 25 to transfer the signal being a processing object via the waveform bus 25.

Further, the waveform bus 25 can transmit a 24-bit signal via 128 channels on a time division basis, and each channel functions as a signal transmission channel for transmitting a signal from the output of any of the signal processors or the I/Os connected to the waveform bus 25 to the input of another signal processor or I/O. More specifically, the channels are assigned to the output side and the input side, and the output of each of the signal processors and I/Os outputs a signal to the channel assigned thereto as the output destination and the input of each of the signal processors and I/Os fetches the signal from the channel assigned thereto as the input source to thereby enable transmission of the signal.

This assignment is basically performed by a microprogram for controlling the DSP 20, but a channel for inputting to the waveform I/O the signal to be outputted from the monitoring analog signal output 19*a* is reserved in advance and is not assigned by the microprogram. Then, the signal from the signal processor designated in accordance with the command from the PC 30 can be transferred over the reserved channel. The required number of channels to be reserved is one for monaural output but two for stereo output.

Further, processing capability of the processor for transferring the signal over the above-described reversed channel is also reserved in advance, and the signal processing in accordance with the microprogram is performed within the residual processing capability.

Figure 3:
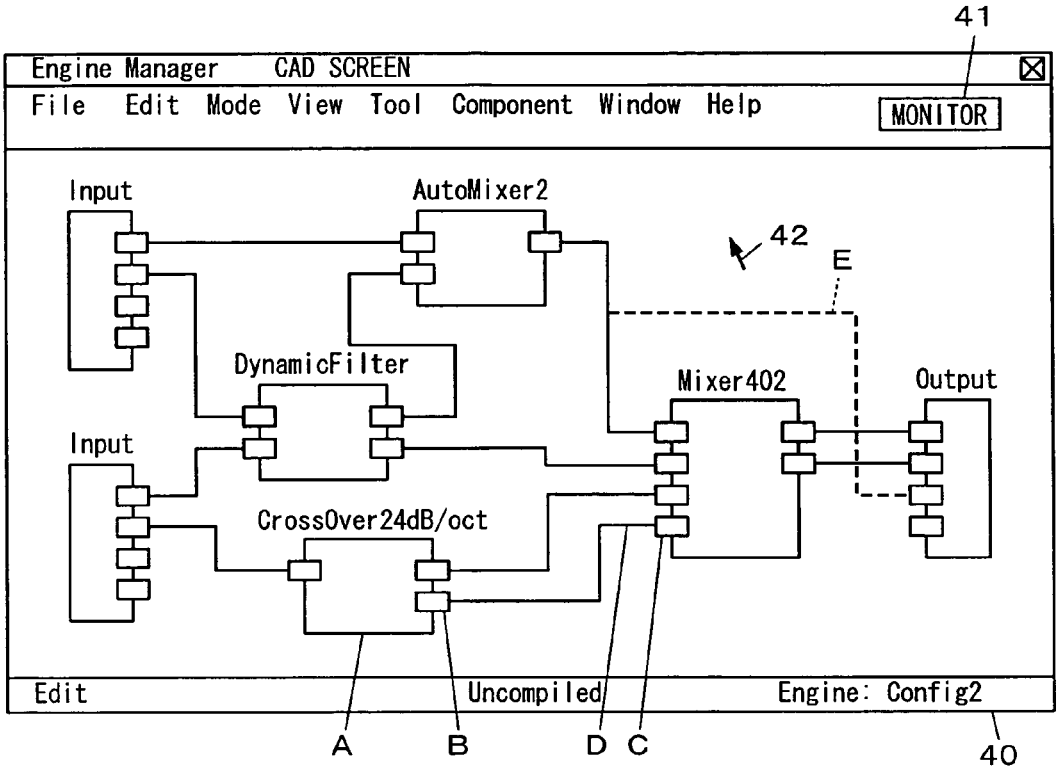
FIG. 3 is a diagram showing an example of an edit screen of a signal processing configuration displayed on a display of a PC shown in FIG. 1.

Next, an editing scheme of the configuration of signal processing in the PC 30 will be described. FIG. 3 is a diagram showing an example of an edit screen of a signal processing configuration displayed on the display of the PC 30.

When the user causes the PC 30 to execute the above-described edit program, the PC 30 causes the display to display a CAD (Computer Aided Design) screen 40 as shown in FIG. 3 to accept an edit direction from the user. In this screen, the configuration of signal processing during the edit is graphically displayed by components (A) such as a DynamicFilter, an AutoMixer2, a Mixer402 and the like and wires (D) connecting output nodes (B) and input nodes (C) of the components. Note that the nodes displayed on the left side of the components are the input nodes, and the nodes displayed on the right side are the output nodes. The components which exhibit input to the mixer engine 10 have only the output nodes, the components which exhibit output from the mixer engine 10 have only the input nodes, and all the other components have both the input nodes and the output nodes.

In this screen, the user can select components desired to be added to the configuration of signal processing from a component list displayed by operation of a "Component" menu by moving a pointer 42 using a pointing device such as a mouse or the like and clicking or dragging it, arrange them on the screen, and designate wires between any of the output nodes and any of the input nodes of the plurality of components arranged, to thereby edit the configuration of signal processing. Note that the transmission channel and the processing capability of the processor are reserved for monitoring as described above, and therefore the arrangement of components and wiring therebetween are performed within the resource other than the reserved in this editing. For example, control is conducted such that editing beyond the resource range cannot be executed or can be executed but a warning is displayed immediately after the execution or at the time when it is transferred to the engine.

By directing execution of "Save" in a "File" menu, the edited result is saved as a configuration (config). Further, by directing execution of "Compile" in the "File" menu, the data format of a part of the configuration data can be converted into the data format for the mixer engine, and then the configuration data can be transferred to and stored in the mixer engine 10.

Further, for each of the components included in the configuration of signal processing, a storage region for storing parameters (for example, the level of each input or the like if it is a mixer) of the component is prepared, when the component is newly disposed and compiled in the configuration of signal processing, in the current scene where the current data is stored, and predetermined initial values are given as the parameters.

Then, the user can edit the parameters stored in the parameter storage region by operating a parameter control panel provided for each component. Further, a plurality of resultant parameters edited here and stored in the current scene are stored in a scene memory in a configuration, as the scene being setting data on the configuration, so that the parameters can be arbitrarily recalled to the current scene when the mixer engine 10 performs signal processing in accordance with the configuration.

Further, the user can set either a non-online mode or an online mode as the operation mode of the mixer engine 10 and the PC 30. In the non-online mode, the mixer engine 10 and the PC 30 operate independently from each other, while, in the online mode, they operate maintaining mutual synchronization of parameters and so on in the current memory. They can shift to the online mode only when the configuration of signal processing of the mixer engine 10 matches the configuration of signal processing of the PC 30. In the online mode, the mixer engine 10 and the PC 30 are controlled (synchronized) such that their data of the current scenes become identical.

Further, when shifting to the online mode, the user can select either the current scene on the mixer engine 10 side or the current scene on the PC 30 side for use as the current scene after synchronization, and further direct that the contents stored in the scene memories should also be synchronized.

After shift to the online mode, the operation performed on the PC 30 side is immediately reflected on the operation of the mixer engine 10, while the operation performed on the control 15 of the mixer engine 10 is immediately reflected on the operation of the PC 30, whereby they are controlled so that the contents of the current scenes of both of them become identical. Note that it is also adoptable to automatically shift them to the online mode when the above-described "Compile" is executed, and to automatically shift them to the non-online mode when the configuration of signal processing on the PC 30 side is changed.

Note that, conventionally, when the signal during processing is desired to be monitored, it is required to provide a monitoring wire E as shown by a broken line connecting a position desired to be monitored and an output component and to transfer the signal processing configuration including the wire to the mixer engine 10. In contrast to the above, that the monitoring of the signal can be performed without provision of such a wire on the CAD screen 40 is a characteristic of the embodiment. However, the wire such as one shown by the symbol E can be set also in the mixer system of the invention.

The configuration of data associated with the invention for use in the above-described mixer system will be described below.

Figure 4:
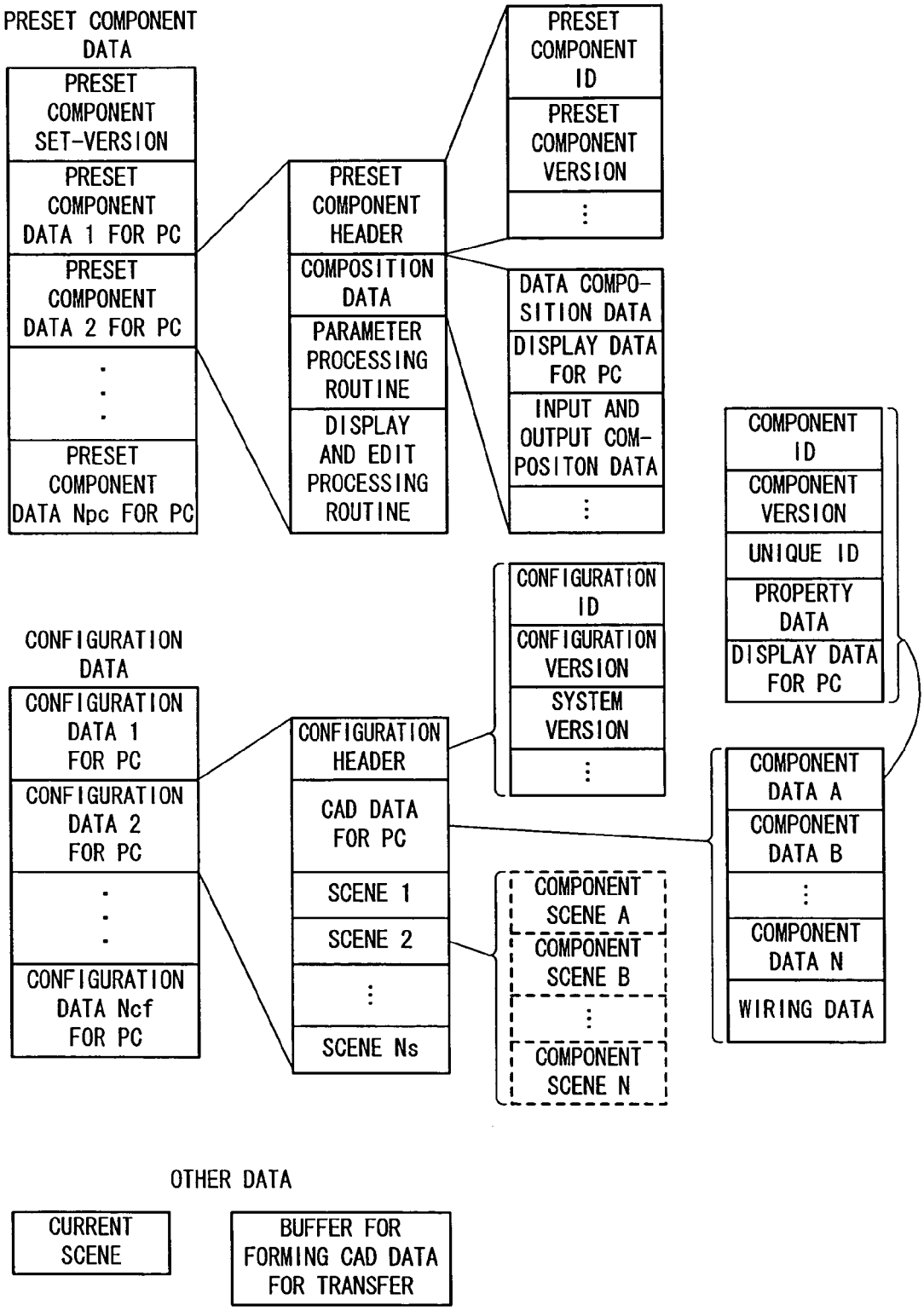
FIG. 4 is a diagram showing a configuration of data for use on the PC side of data relating to the invention.

First, the configuration of data for use on the PC 30 side will be shown in FIG. 4.

As shown in the drawing, when the above-described edit program is executed on the OS of the PC 30, the PC 30 stores preset component data and configuration data in a memory space defined by the edit program.

Of them, the preset component data is a set of data on components which can be used in editing signal processing and basically supplied from its manufacturer, although it may be configured to be customizable by the user. The preset component data includes data of preset component set-version data being version data for managing the version as the whole data set, and preset component data for PC prepared for each kind of the plurality of components constituting the data set.

Each preset component data for PC, which is data indicating the property and function of a component, includes: a preset component header for identifying the component; composition data showing the composition of the input and output of the component and data and parameters that the component handles; a parameter processing routine for performing processing of changing the value of the individual parameter of each component in each scene in the above-described current and scene memory in accordance with the numerical value input operation by the user; and a display and edit processing routine for converting the parameters of each component in the scenes into text data or a characteristic graph for display.

The preset component header includes data on a preset component ID indicating the kind of the preset component and a preset component version indicating its version, with which the preset component can be identified.

The above-described composition data also includes display data for PC indicating color and shape when the component itself is displayed in the edit screen, the design of the control panel displayed on the display for editing the parameters of that component, and the arrangement of the knobs and the characteristic graph on the control panel and so on, as well as the input and output composition data indicating the composition of the input and output of the component, and the data composition data indicating the composition of data and parameters that the component handles.

On the other hand, the configuration data, which is data indicting the configuration of signal processing that the user edits, is saved when the user selects save of the edit result, in such a manner that the configuration of signal processing, the setting values and so on at that point in time are saved as one set of configuration data for PC. Each configuration data for PC includes: a configuration header for identifying the configuration data; CAD data for PC indicating the contents of the edited configuration of signal processing; and scenes being the above-described setting data.

Among these, the configuration header includes data such as a configuration ID uniquely assigned when the configuration is newly saved, a configuration version indicating a modified version by changing when the configuration data is modified, a system version indicating the version of the edit program with which the configuration data is created, and so on.

Besides, the CAD data for PC includes component data on each component included in the edited configuration of signal processing and wiring data indicating the wiring status between the components. Note that if a plurality of preset components of the same kind are included in the configuration of signal processing, discrete component data is prepared for each of them.

Each component data includes: a component ID indicating what preset component that component corresponds to; a component version indicating what version of preset component that component corresponds to; a unique ID being an ID uniquely assigned to that component in the configuration of signal processing in which that component is included; property data including data of the numbers of the input nodes and output nodes of that component and so on; and display data for PC indicating the position where the corresponding component is arranged in the edit screen on the PC 30 side and so on.

Besides, the wiring data includes, for each wire of a plurality of wires included in the edited configuration of signal processing: connection data indicating what output node of what component is being wired to what input node of what component; and display data for PC indicating the shape and arrangement of that wire in the edit screen on the PC 30 side.

Besides, each scene in the scene memory is an aggregation of component scenes being parameters on each component of the configuration of signal processing, and the format and array of data in each component scene are defined by the data composition data in the preset component data for PC of the preset component which is identified by the component ID and the component version of that component included in the CAD data for PC.

The above are main data for use on the PC 30 side, and these data may be stored in a non-volatile memory such as an HDD (hard disk drive) or the like and read out into the RAM for use when required.

In addition to the above data, the PC 30 also stores the current scene being the setting data which is currently effective in the currently effective configuration. The data of the current scene has the same configuration as that of each scene in the above-described scene memory, so that when the parameters of one component in the configuration of signal processing are edited on the control panel or the like, the edit is performed by modifying the parameters of that component in the current scene and the result can be saved in the scene memory as one scene.

Further, in the PC 30, a buffer for forming, from the CAD data for PC, CAD data for transfer to engine when transferring the configuration data to the mixer engine 10 in the above-described "Compile" processing is provided. Note that the CAD data for transfer to engine is created by deleting from the CAD data for PC the data not in use on the mixer engine 10 side such as the above-described display data for PC on the component and wiring and further cutting off a portion not in use between the data for packing.

Figure 5:
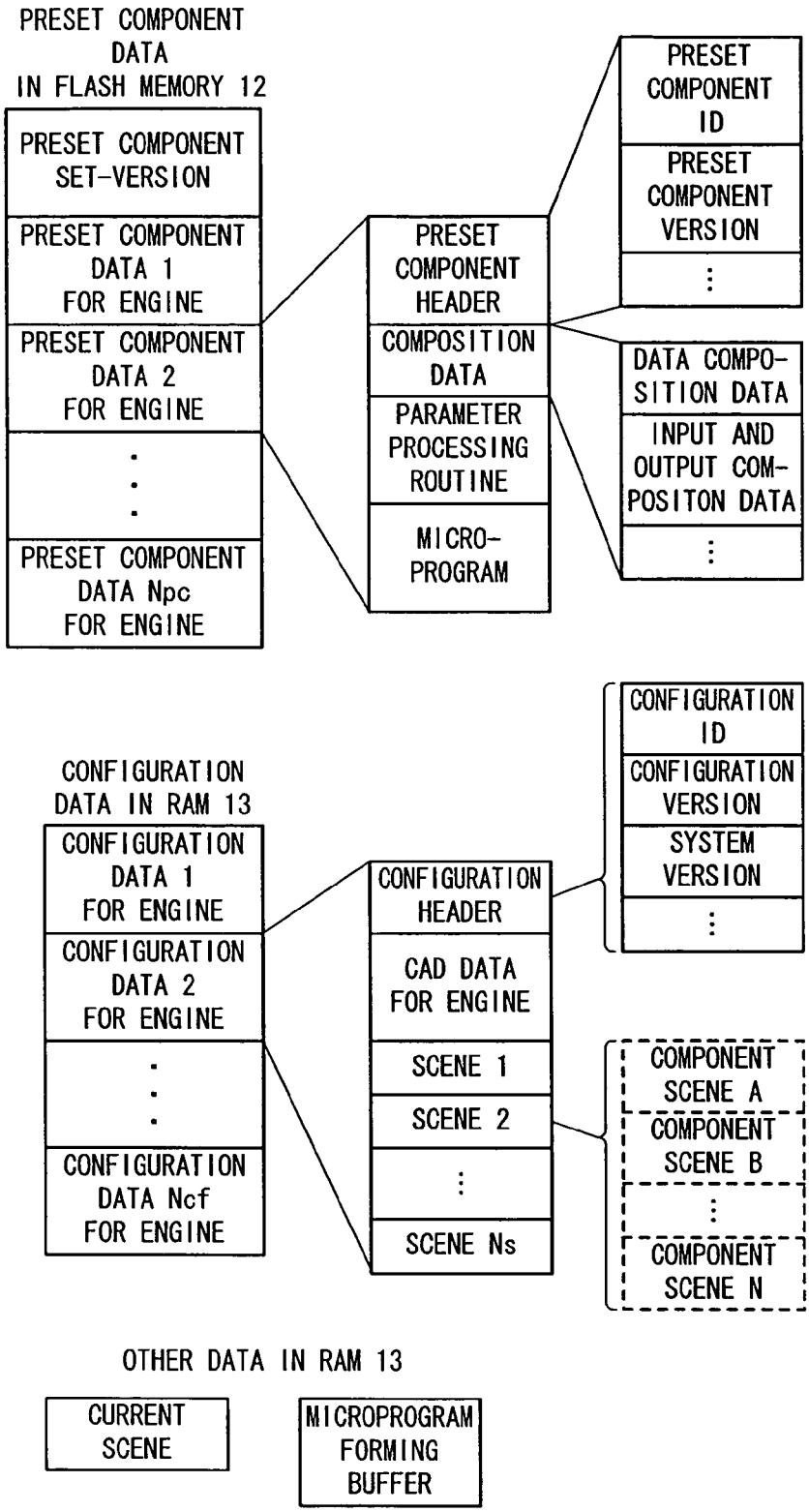
FIG. 5 is a similar diagram showing a configuration of data for use on a mixer engine side.

Next, the configuration of data for use on the mixer engine 10 side will be shown in FIG. 5.

As shown in the drawing, on the mixer engine 10 side, preset component data and configuration data are also stored as primary data. Incidentally, the preset component data is stored in the flash memory 12 and the configuration data in the RAM 13, their configuration contents being slightly different from those on the PC 30 side. Hence, points different from the data to be stored on the PC 30 side will be mainly described.

As shown in FIG. 5, the preset component data on the mixer engine 10 side includes preset component data for engine. The preset component data for engine is firstly different from the preset component data for PC in that it includes the microprogram for operating the DSP 20 to realize signal processing relating to a component, in place of a part of the display and edit routine. The preset component data for engine is different from that for PC also in that it does not include the display data for PC in composition data.

In other words, since edit of the configuration of signal processing and display of the characteristic graph of the parameter are not performed on the mixer engine 10 side, the display data for PC included in the composition data for the PC and a part of the display and edit routine for PC, are not necessary. Note that also on the mixer engine 10 side, the setting values of parameters can be displayed on the display 14 and edited by the control 15. Therefore, the routine for converting the values of the parameters into text data for display of the display and edit routine for PC is required and included in the parameter processing routine.

The preset component data is the same as that on the PC 30 side in points other than the above, so that the same ID and version as those of the corresponding sets and components on the PC 30 side are used to enable recognition of the correspondence therebetween.

Secondly, as for the configuration data, the configuration data for engine is different from that for PC 30 in that it includes CAD data for engine in place of the CAD data for PC. Here, the CAD data for engine is the CAD data for transfer to engine received from the PC 30 and stored, which is created by deleting the display data for PC from the CAD data for PC and packing as described above.

The configuration data is the same as that on the PC 30 side in points other than the above, so that the same ID and version as those of the corresponding configurations and components on the PC 30 side are used to enable recognition of the correspondence therebetween.

Note that the mixer engine 10 is for processing audio signals based on the configuration of signal processing edited on the PC 30. Accordingly, the CPU 11 forms the microprogram which the DSP 20 executes, based on the CAD data for engine received from the PC 30, and thus has a microprogram forming buffer prepared as a work area for the formation.

In microprogram forming processing, the above-described microprogram is sequentially read out from the preset component data specified by the component ID and the component version of each component included in the CAD data for engine; assignment of resources such as an input/output register, a delay memory, a store register, a transmission channel, and so on which are required for operation of each component is performed; and the microprogram is processed based on the assigned resources and then written into the microprogram forming buffer.

Then, the channel for transmission in the waveform bus 25 is assigned to the necessary signal processor or I/O referring to the wiring data, and the read address and write address when data is passed between components are decided, and then a program for passing data between the input/output registers corresponding to the input and output nodes of the components is written into the microprogram forming buffer, thereby completing the microprogram to be given to the DSP 20.

The reason why the microprogram is processed based on the resource assignment here is to correspond it to the architecture of the DSP 20 included in the mixer engine 10. Therefore, for another architecture, a parameter corresponding to the assigned resource, for example, may need to be set in the DSP 20 in place of processing the microprogram itself.

Next, operation in the monitor mode in the mixer system will be described.

In the mixer system, upon activation of the above-described edit program, the PC 30 connected to the mixer engine 10 operates in two kinds of modes, which can be switched by the direction of the user, that is, an offline processing mode in which the PC 30 can edit the signal processing configuration and transfer it to the mixer engine 10, and an online control mode in which the PC 30 cannot modify the signal processing configuration but can cause the mixer engine 10 to execute signal processing relating to the transferred signal processing configuration and can edit parameters relating to the signal processing during the execution.

Figure 6:
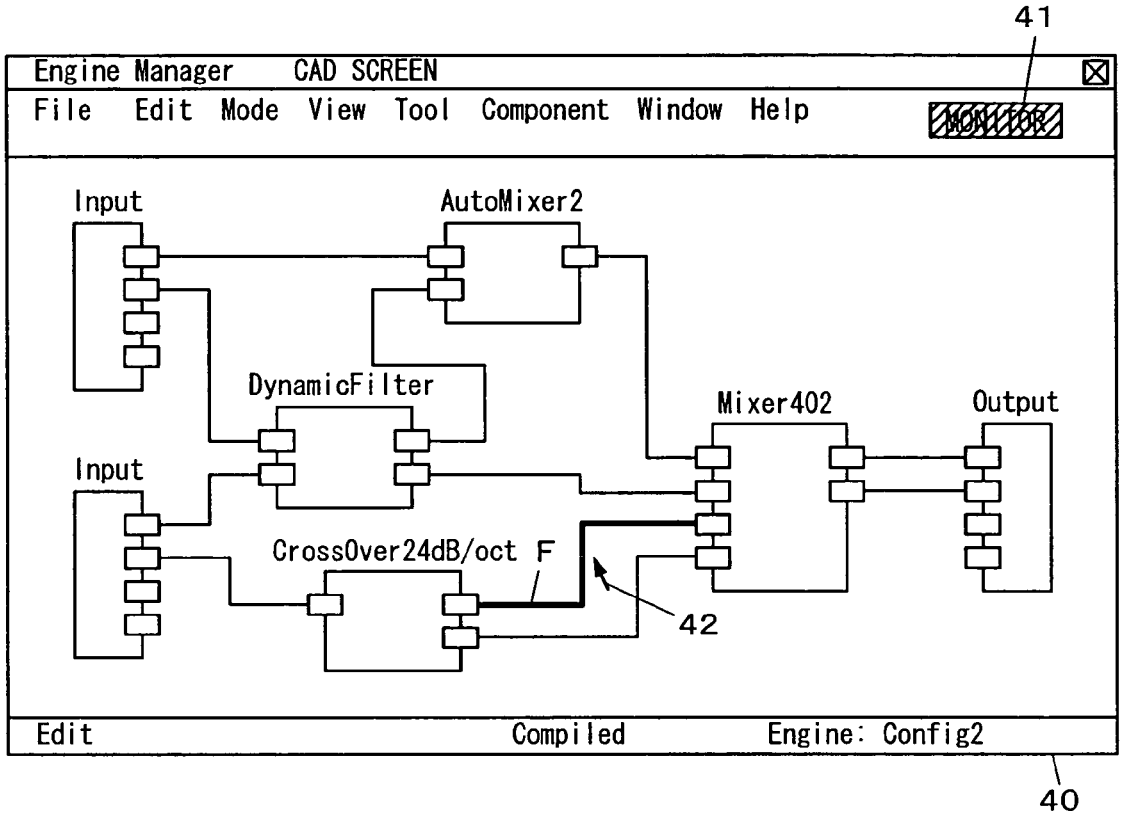
FIG. 6 is a diagram showing an example of an edit screen of a signal processing configuration in a monitor mode.

Further, in the online control mode of them, pressing a monitor key 41 shown in FIG. 2 allows the mixer system to shift into a monitor mode. FIG. 6 is a diagram showing an example of an edit screen of a signal processing configuration in the monitor mode.

As shown in FIG. 6, display on the edit screen in the monitor mode is not so different from that before shifting into the monitor mode. In the monitor mode, however, the user can designate the point where the signal is to be monitored. This designation can be performed by moving the pointer 42 and clicking or the like to select a wire or a node. The wiring at the designated point (when a node is selected, a wire connected to the node) is displayed in distinction from other wires, as shown by a symbol F, so as to indicate that the signal at that portion is being monitored.

Further, when designation of a monitoring point is given, the PC 30 transmits a command to direct the mixer engine 10 to output the signal at the designated point to the monitoring analog signal output 19*a*. This command designates the point to be monitored through use of the unique ID and the node number specifying the output node of the component outputting the signal to the clicked wire on the edit screen (CAD screen 40).

Then, the mixer engine 10 accepted the command uses the transmission channel of the waveform bus 25 and the processing capability of the DSP 20 which have been reserved in advance as described above to transfer the signal at the directed point to the waveform I/O 19 and output it from the monitoring analog signal output 19*a*.

More specifically, processing is performed which copies data at the directed point (output data of the output node of the component specified by the unique ID and the node number) to the register for transferring it to the monitoring analog signal output 19*a* of the waveform I/O 19. This register is an output register of the DSP 20 which is set in advance such that the data written into the register is outputted to the channel reserved for outputting it to the monitoring analog signal output 19*a* of the waveform bus 25.

When a monitoring point is designated once and then another point is designated, monitoring of the previously designated point is released. Then, the PC 30 transmits to the mixer engine 10 a command to output the signal at the newly designated point to the monitoring analog signal output 19*a*, and the mixer engine 10 accepted the command transfers the signal at the newly directed point to the waveform I/O 19 and outputs it from the monitoring analog signal output 19*a* as in the above described case. Accordingly, it is possible to monitor the signal at the newly designated point without changing the signal processing configuration. Processing at the time of changing the monitoring point is just transmitting one command to the mixer engine 10, thus making it possible to speed up the response and easily perform an operation such as performing monitoring with the monitoring point changed in sequence.

Although the example in which the signal at only one point is monitored is described here, it is also possible to monitor signals at two points at the same time if the monitoring analog signal output 19*a* is for stereo output and transmission channels and processing capability for two channels are ensured to conform to the output. In this case, there is a conceivable designating method of, for example, designating the point to be monitored by an L-channel by clicking at a first time while pressing the shift key, and designating the point to be monitored by an R-channel by clicking at a second time. Then, the mixer engine 10 will perform processing of copying data at the two directed points to the registers for transferring it to an L-output and an R-output of the monitoring analog signal output 19*a* respectively.

Next, concrete processing performed by the PC 30 executing the edit program will be described. Processing which is being executed at all times during operation of the edit program is shown in a flowchart of FIG. 7.

Figure 7:
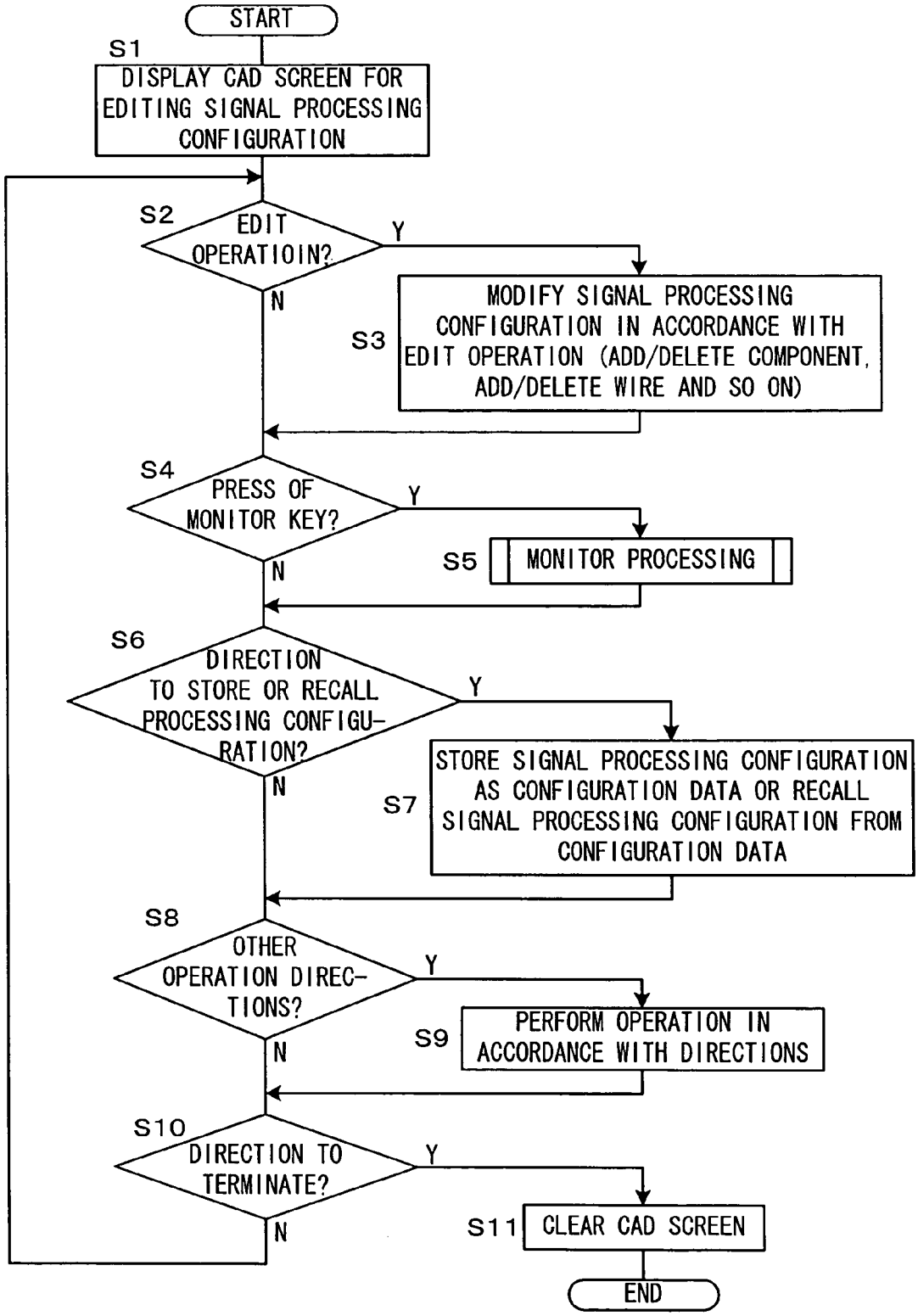
FIG. 7 is a flowchart showing basic processing during execution of an edit program in the PC shown in FIG. 1.

When directed to execute the edit program by the user, the CPU of the PC 30 starts the processing shown in the flowchart of FIG. 7. This processing realizes the function of editing the configuration of signal processing performed in the mixer engine 10.

In this processing, the CPU displays the CAD screen 40 for editing the signal processing configuration as shown in FIG. 3 in Step S1, and accepting edit operation, press of the monitor key, direction to store and recall the processing configuration, and other operation directions and performing processing in accordance with the directions in Steps S2 to S9. When given a direction to terminate the edit program, the CPU proceeds from Step S10 to Step S11 to clear the CAD screen 40, and terminates the processing.

As described above, the edit program is for causing the CPU to realize various functions including editing of the configuration of signal processing performed in the mixer engine 10, by detecting various events including operation of the user and performing operation in accordance therewith. However, it becomes complicated when processing for realizing these functions is described one by one, and therefore only the contents of monitor processing (S5) for realizing the function of monitoring the signal during processing in the above-described signal processing that is the function relating to characteristics of the embodiment will be described hereinafter and description of other processing will be omitted. Note that the monitor key 41 cannot be pressed in modes other than the above-described online control mode, and this shall be indicated by half-luminance display or the like.

Figure 8:
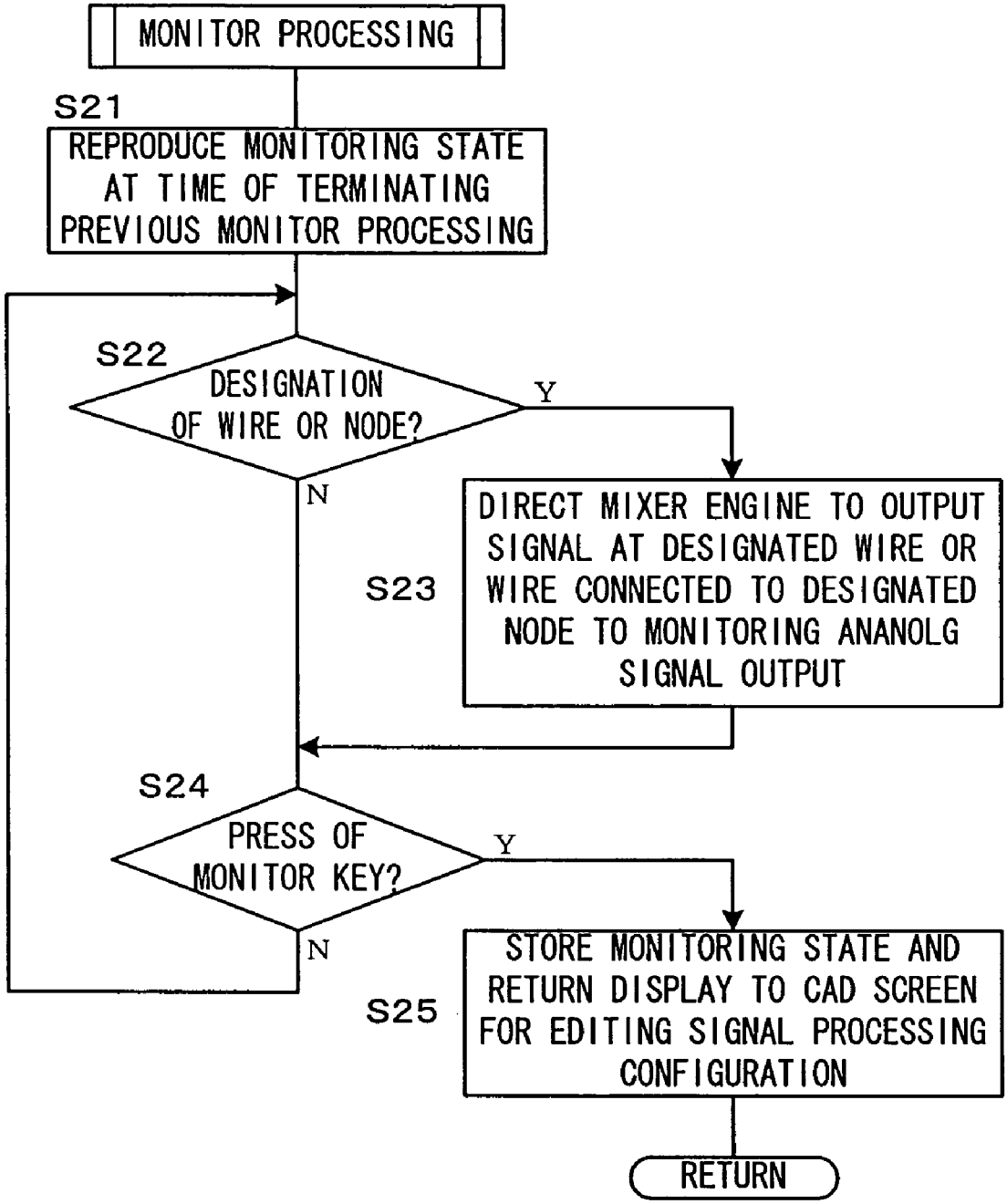
FIG. 8 is a flowchart showing monitor processing shown in FIG. 7.

The monitor processing in FIG. 7 is processing of performing the operation in the above-described monitor mode, in which the CPU of the PC 30 executes processing shown in a flowchart of FIG. 8.

In this processing, if storing the monitoring state at the time of terminating previous monitor processing, the CPU reproduces the state (S21). More specifically, at the time of terminating the processing, the CPU is configured to store the monitoring point designated at the point of time (S25), and therefore transmits to the mixer engine 10 a command to output the signal at the stored monitoring point to the monitoring analog signal output 19*a*. However, if the signal processing configuration is edited after the monitoring point is stored, the storage is cleared so that the CPU does not perform any processing in Step 21.

Subsequent to Step S21, the CPU repeats Steps S22 to S24, in which the CPU accepts designation of a wire or node to be monitored on the CAD screen, and when designation is given, the CPU transmits to the mixer engine 10 a command to output the signal at the point to the monitoring analog signal output 19*a*. Then, when the monitoring key 41 is pressed again, the CPU stores the monitoring state (monitoring point) at that point of time in Step S25 and returns display to the normal CAD screen as shown in FIG. 2 to thereby return to the basic processing. In this processing, the CPU of the PC 30 functions as an accepting device and a directing device.

This mixer system is configured as described above and performs the above processing, whereby the user can monitor the signal at a point where the user desires to monitor it only by designating the wire or node at the point in the CAD screen in the monitor mode. In this case, the user does not have to reserve a node of an output component for monitoring or to set a wire from the point where the user desires to monitor the signal to the node. As a matter of course, it is also unnecessary to transfer the signal processing configuration after setting of the wire to the mixer engine 10. Accordingly, it is possible to greatly improve the operability when monitoring the signal during processing, so that monitoring can be easily performed.

In addition, reconfiguration of the microprogram accompanying a modification of the signal processing configuration is not necessary, and the monitoring point can be changed only by transmitting a command to designate the monitoring point to the mixer engine 10 from the PC 30, thus making it possible to speed up the response and easily perform an operation such as performing monitoring with the monitoring point changed in sequence.

Further, since the transmission channel and processing capability are reserved in advance for transferring data of signal from the designated monitoring point (the signal processor for performing processing corresponding to the point) to the monitoring analog signal output, such a situation can be prevented that the monitoring wire cannot be added due to lack of hardware resource.

With the above, the description of the embodiment is finished, but the invention is not limited to the above embodiment. For example, the monitoring point may be designated not only by directly clicking a wire or node but also by selecting from a list or selecting a number. Further, it is also conceivable that when a component is right-clicked, a list of the input nodes or output nodes of the component is displayed to allow a node being a monitoring object to be selected from the list.

Although the example in which the monitoring analog signal output 19*a* is prepared in the mixer engine 10 as a special sound out terminal for monitoring is described here, it is also possible that the special terminal as described above is not provided but an arbitrary sound out terminal in the waveform I/O 19 is designated for monitoring and handled similarly to the above-described monitoring analog signal output 19*a*. The terminal designated for monitoring may be an analog output terminal or a digital output terminal, and a sound out device such as a headphone, a speaker, or the like is connected to the terminal, whereby monitoring of signal can be performed as in the case of using the monitoring analog signal output 19*a*, through one terminal is decreased which can be used for outputting sound after signal processing.

Further, as a modification of the above-described embodiment, it is also conceivable that the mixer engine outputs a signal for monitoring to the PC 30 side. Such a modified example will be described here using FIG. 9 and FIG. 10.

Figure 9:
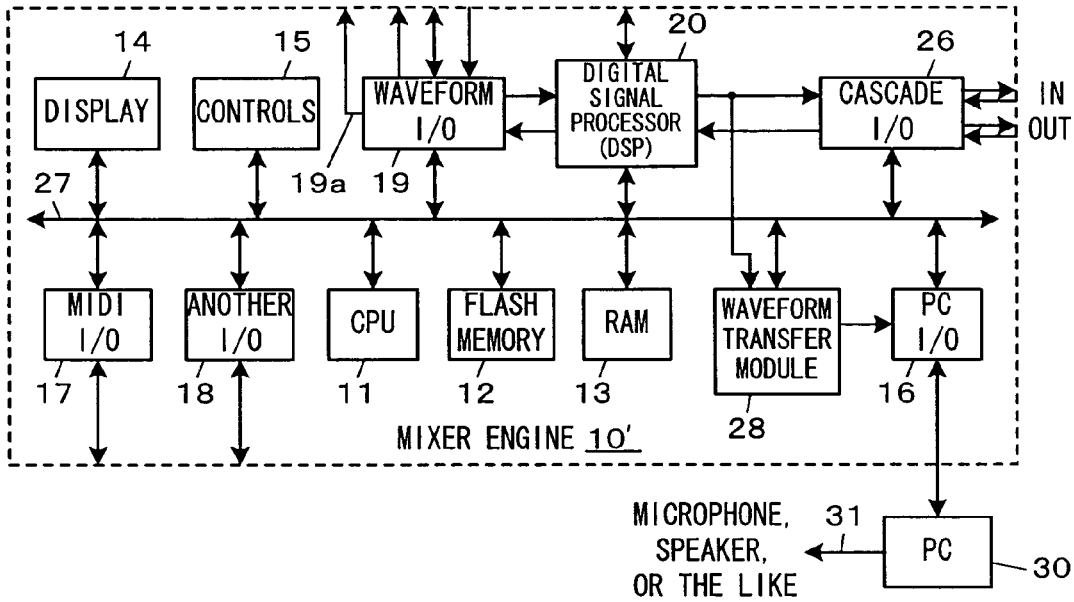
FIG. 9 is a block diagram, corresponding to FIG. 1, showing a configuration of a modified example of the mixer system.

FIG. 9 is a block diagram, corresponding to FIG. 1, showing a configuration of a mixer system of the modified example.

This mixer system is different from the mixer system shown in FIG. 1 only in that a waveform transfer module 28 is provided in a mixer engine 10' and a sound out terminal 31 is provided in a PC 30, and therefore the mixer system will be described only on the point relating to them.

The waveform transfer module 28 has a function of outputting an audio signal outputted from a DSP 20 to the PC 30 via a PC I/O 16. In this case, the PC I/O 16 corresponds to an output portion. Further, various kinds of connection forms are possible between the PC 30 and the mixer engine 10', and when the PC I/O 16 is a USB standard interface, it originally has a function of transferring the audio signal in real time and thus can output the signal using the function. Besides, in the USB bus network, normally the PC 30 controls, as a USB host, communication between a plurality of devices connected to the network.

Alternatively, when the PC I/O 16 is an interface for performing communication via the network using the Ethernet or the like, it can transfer the audio signal using a technique such as CobraNet (registered trademark). Further, in the Ethernet, the devices connected to the network operate as hosts respectively to conduct communications between the devices based on the MAC (Media Access Control) address unique to each of the devices or the IP address based on the TCP/IP (Transmission Control Protocol/Internet Protocol) protocol.

Since a plurality of devices are connected to the network when using the USB or Ethernet, the PC 30 specifies the mixer engine 10' which the PC 30 itself controls from among the plurality of devices connected to the network, using the ID or address of the device connected to the network, and transmits/receives various kinds of data such as a direction command, signal processing configuration, parameter, audio signal to/from the specified mixer engine. When a plurality of PCs are connected via the Ethernet, the mixer engine 10' may be controlled to transmit the audio signal to a specific PC using its network address or selectively accept only control from a specific PC. Further, the operation of the waveform transfer module 28 supplying waveform data to be transmitted to the PC I/O 16 is controlled by a CPU 11.

Further, the sound out terminal 31 of the PC 30 is a terminal for connecting a sound out device such as a headphone, a speaker, or the like, and the PC 30 outputs the audio signal inputted from the mixer engine 10' via the network to the sound out device via the sound out terminal 31, whereby the audio signal can be outputted as sound.

Figure 10:
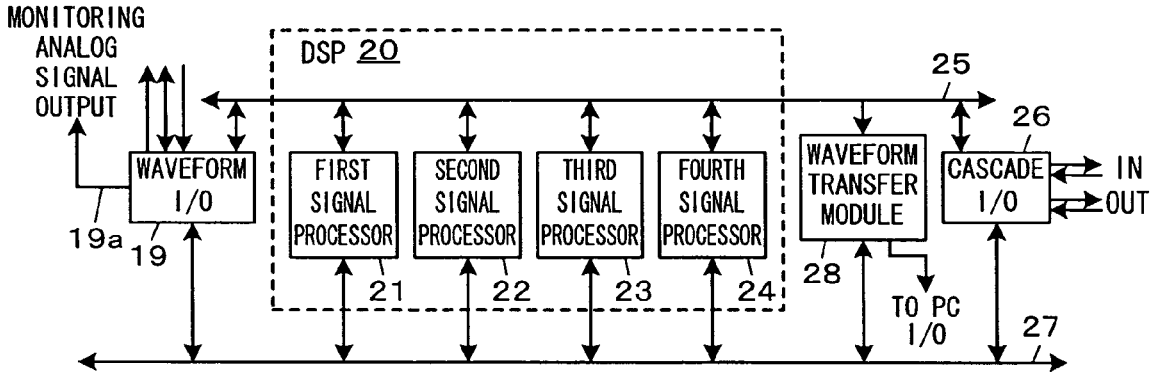
FIG. 10 is a diagram, corresponding to FIG. 2, showing a configuration of a DSP and its periphery shown in FIG. 9 in more detail.

Besides, FIG. 10 is a block diagram, corresponding to FIG. 2, showing a configuration of the DSP 20 and its periphery in the mixer engine 10' in more detail.

As shown in the drawing, the waveform transfer module 28 is connected to a waveform bus 25 to be able to selectively fetch a signal at an arbitrary channel of signals at a plurality of channels processed in signal processors 21 to 24 in the DSP 20 and outputted to the waveform bus 25, and to transmit it to the PC 30 via the PC I/O 16. It is suitable to set the same channel, which has been reserved for inputting into the waveform I/O the signal which is to be outputted from the monitoring analog signal output 19*a*, as a channel from which the waveform transfer module 28 fetches a signal.

Then, in this mixer system, when accepting designation of a monitoring point in the screen as shown in FIG. 6, the PC 30 transmits to the mixer engine 10' a command to direct it to output the signal at the designated point to the PC 30. Then, the mixer engine 10' accepting the command transfers the signal at the directed point to the waveform transfer module 28 using the transmission channel of the waveform bus 25 and the processing capability of the DSP 20 which have been reserved in advance. More specifically, processing is performed which copies data at the directed point to an output register for outputting it to the channel from which the waveform transfer module 28 fetches the signal. Then, the waveform transfer module 28 transmits the signal to the PC 30 via the PC I/O 16.

This allows the user to obtain on the PC 30 side the signal at the point designated on the PC 30, and to monitor the signal with ease by outputting the signal to the headphone or speaker via the sound out terminal 31 even when the mixer engine 10' being a control object and the PC 30 are located at positions physically separated from each other. Further, transfer of the signal for monitoring is possible via the connection line usually used for connection between the mixer engine 10' and the PC 30.

Note that although a signal is outputted both to the monitoring analog signal output 19*a* and the waveform transfer module 28 using one transmission channel in the waveform bus 25 so that the same signal is monitored at the monitoring analog signal output 19*a* and the sound out terminal 31, it is also suitable to monitor discrete signals by reserving different channels for monitoring and designating monitoring points independently from each other. Alternatively, the configuration may be arranged such that ON/OFF of transmission of a signal for monitoring to the PC 30 can be set.

Besides, though the audio signal is transferred via the network only in one direction from the mixer engine 10' to the PC 30 in the modified example, it is suitable to allow the signal to be also transmitted from the PC 30 to the mixer engine 10'. The use of the channel even makes it possible to input voice of an operator through the analog input of the PC 30 and transmit it from the PC 30 to the mixer engine 10' as a talk back signal. This configuration allows performers on the mixer engine 10' side to hear the talk back signal from the operator of the PC 30.

Further, the configuration of the mixer system is not limited to those shown in FIG. 1 and FIG. 9 as a whole, and a dedicated editing device or controller may be used as the editing device in place of the PC 30. The audio signal processing device is not limited to one, but a plurality of devices may be simultaneously connected to the editing device.

Besides, the computer executing the program of the invention is not limited to the PC, but one mixer engine may be connected to different computers according to time and circumstances for control.

Further, the above-described program of the invention is stored in the HDD of the PC 30 and so on in advance, and the same effect can be obtained also by providing the program recorded on a non-volatile recording medium (memory) such as a CD-ROM, a flexible disc, or the like and causing the CPU to load for execution the program from the memory to the RAM of the PC 30 or by causing the CPU to download for execution from an external device including a recording medium recording the program thereon or an external device storing the program in a memory such as an HDD or the like.

As has been described, according to the audio signal processing system or the program of the invention, it is made possible to easily monitor a signal during processing in an audio signal processing system including an audio signal processing device wherein processing contents can be programmed and an editing device for editing the configuration of signal processing. Accordingly, an audio signal processing system with a high operability can be provided.

What is claimed is:

1. An audio signal processing system comprising an audio signal processing device having a plurality of signal processors wherein processing contents can be programmed, and an editing device that edits a configuration of signal processing including a plurality of components each having one or more input terminals or one or more output terminals, and wires connecting the output terminals and input terminals of the components in the audio signal processing device, wherein said editing device is comprised of:

a display controller that graphically displays, on a screen of a display, a graphical user interface that illustrates the edited configuration of signal processing using the components and the wires;

a transferring device that transfers the edited configuration of signal processing to the audio signal processing device;

an accepting device that accepts, in response to a user selection using the graphical user interface displayed on the screen, designation of one of said plurality of terminals or wires of which a signal is desired to be monitored, while said audio signal processing device is performing signal processing in accordance with the configuration of signal processing transferred from the transferring device; and a directing device that directs the audio signal processing device to output the signal from the designated terminal or wire to a predetermined output portion in accordance with the designation accepted by the accepting device, wherein said audio signal processing device is comprised of:

a waveform bus via which signals of a plurality of signal transmission channels are transmitted between devices connected thereto, and an outputting device, connected to said waveform bus, that receives a signal via said waveform bus and outputs the received signal to the predetermined output portion, wherein said plurality of processors are connected to said waveform bus and share said signal processing in accordance with the configuration of signal processing transferred from the editing device, and wherein at least one of the plurality of signal transmission channels and processing capability of the processors are reserved for monitoring and, wherein said signal at the designated terminal or wire in said signal processing is transmitted from the processors to said outputting device using the reserved signal transmission channel and the reserved processing capability of the processors in accordance with the direction from the directing device.

2. The audio signal processing system according to claim 1, wherein said predetermined output portion is an output portion for outputting a signal from the audio signal processing device to the editing device, and wherein said editing device is provided with a second outputting device that outputs the signal inputted from the audio signal processing device to a sound out device.

3. The audio signal processing system according to claim 1, wherein said signal processing in accordance with the configuration of signal processing transferred from the editing device is performed using signal transmission channels and processing capability of the processors which are not reserved for the monitoring in said audio processing device.

4. An audio signal processing system comprising an audio signal processing device that is connected to a network and has a plurality of signal processors wherein processing contents can be programmed, and an editing device that is connected to the network and edits a configuration of signal processing including a plurality of components each having one or more input terminals or one or more output terminals, and wires connecting the output terminals and input terminals of the components in the audio signal processing device, wherein said editing device is comprised of:

a display controller that graphically displays, on a screen of a display, a graphical user interface that illustrates the edited configuration of signal processing using the components and the wires;

a transferring device that transfers the edited configuration of signal processing to the audio signal processing device via the network;

an accepting device that accepts, in response to a user selection using the graphical user interface displayed on the screen, designation of one of said plurality of terminals or wires of which a signal is desired to be monitored, while said audio signal processing device is performing signal processing in accordance with the configuration of signal processing transferred from the transferring device;

a directing device that directs via the network the audio signal processing device to transmit the signal at the designated terminal or wire to said editing device via the network in accordance with the designation accepted by the accepting device; and an outputting device that outputs to a sound out device the signal received from the audio signal processing device via the network, wherein said audio signal processing device is comprised of:

a waveform bus via which signals of a plurality of signal transmission channels are transmitted between devices connected thereto;

a transmitting device, connected to said waveform bus, that receives a signal via said waveform bus and transmits the received signal to the editing device via the network, wherein said plurality of processors are connected to said waveform bus and share said signal processing in accordance with the configuration of signal processing transferred from the editing device, and wherein at least one of the plurality of signal transmission channels and processing capability of the processors are reserved for monitoring and, wherein said signal at the designated terminal or wire in said signal processing is transmitted from the processors to said transmitting device using the reserved signal transmission channel and the reserved processing capability of the processors in accordance with the direction from the directing device.

5. The audio signal processing system according to claim 4, wherein said signal processing in accordance with the configuration of signal processing transferred from the editing device is performed using signal transmission channels and processing capability of the processors which are not reserved for the monitoring in said audio processing device.

6. A machine-readable medium containing program instructions executable by a computer and causing said computer to execute:

a process of editing a configuration of signal processing in an audio signal processing device having a plurality of signal processors wherein processing contents can be programmed, including a plurality of components each having one or more input terminals or one or more output terminals, and wires connecting the output terminals and input terminals of the components;

a process of graphically displaying, on a screen of a display, a graphical user interface that illustrates the edited configuration of signal processing using the components and the wires;

a process of transferring the edited configuration of signal processing to the audio signal processing device;

an acceptance process of accepting, in response to a user selection using the graphical user interface displayed on the screen, designation of one of said plurality of terminals or wires of which a signal is desired to be monitored, while said audio signal processing device is performing signal processing in accordance with the configuration of signal processing transferred from the computer; and a direction process of directing the audio signal processing device to output the signal from the designated terminal or wire to a predetermined output portion in accordance with the designation accepted in the acceptance process, wherein said audio signal processing device is comprised of:

a waveform bus via which signals of a plurality of signal transmission channels are transmitted between devices connected thereto;

an outputting device, connected to said waveform bus, that receives a signal via said waveform bus and outputs the received signal to the predetermined output portion, wherein said plurality of processors are connected to said waveform bus and share said signal processing in accordance with the configuration of signal processing transferred from the editing device, and p1 wherein at least one of signal transmission channels and processing capability of the processors are reserved for monitoring and, wherein said signal at the designated terminal or wire in said signal processing is transmitted from the processors to said outputting device using the reserved signal transmission channel and the reserved processing capability of the processors in accordance with the direction from the computer executing the direction process.

7. The machine-readable medium according to claim 6, wherein said signal processing in accordance with the configuration of signal processing transferred from the computer is performed using signal transmission channels and processing capability of the processors which are not reserved for the monitoring in said audio processing device.

* * * * *